US009573395B2

(12) United States Patent
Anami et al.

(10) Patent No.: US 9,573,395 B2
(45) Date of Patent: Feb. 21, 2017

(54) SERIAL PRINTERS AND LINE PRINTERS

(71) Applicant: SEIKO EPSON CORPORATION, Tokyo (JP)

(72) Inventors: Akira Anami, Kitakyushu (JP); Kazuhiko Tsuyama, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/747,740

(22) Filed: Jun. 23, 2015

(65) Prior Publication Data

US 2015/0367657 A1 Dec. 24, 2015

(30) Foreign Application Priority Data

Jun. 24, 2014 (JP) ..... 2014-129437

(51) Int. Cl.
*B41J 11/06* (2006.01)

(52) U.S. Cl.
CPC ..... *B41J 11/06* (2013.01)

(58) Field of Classification Search
CPC ..... B41J 11/06
See application file for complete search history.

(56) References Cited

U.S. PATENT DOCUMENTS

2005/0062794 A1* 3/2005 Kanamitsu ..... B41J 2/16523 347/31
2007/0263027 A1* 11/2007 Suzuki ..... B41J 2/1721 347/31
2009/0219339 A1* 9/2009 Harada ..... B41J 2/1721 347/36
2011/0025756 A1* 2/2011 Tsuyama ..... B41J 2/16508 347/31

FOREIGN PATENT DOCUMENTS

JP 2008-055841 A 3/2008

* cited by examiner

*Primary Examiner* — Bradley Thies
(74) *Attorney, Agent, or Firm* — Workman Nydegger

(57) ABSTRACT

An ink jet recording apparatus includes a case; a recording head that performs recording by ejecting liquid to a medium provided in the case; a base portion provided in a position that faces the recording head and has a medium supporting portion that supports the medium; a protruding portion that is provided in any one of an area facing a bottom portion of the case in the medium supporting portion or an area facing the base portion in the bottom portion in the case, protrudes to the other one, and extends in a first direction intersecting a transportation direction of the medium; and a receiving portion that is provided in any one of an area facing the bottom portion of the case in the medium supporting portion and an area facing the medium supporting portion in the bottom portion of the case, and receives the protruding portion.

9 Claims, 10 Drawing Sheets

SERIAL PRINTERS AND LINE PRINTERS

BACKGROUND

1. Technical Field

The present invention relates to an ink jet recording apparatus that performs recording by ejecting liquid to a medium.

In the invention, examples of the ink jet recording apparatus include a serial printer that performs recording while a recording head moves in a predetermined direction, a line printer in which a recording head does not move, and a copying machine or a facsimile that has functions of these printers.

2. Related Art

According to the spread of a notebook computer, it is common that a user carries the notebook computer, and the user works on the notebook computer at the place to which the notebook computer is carried. According to this, a user who works with the notebook computer may desire to print data created by the notebook computer with a printer at the place to which the notebook computer is carried. Therefore, the printer should be small and light weight, so that the user can easily carry (see JP-A-2008-55841).

In the recording apparatus, on the lower side of a carriage movably formed in a predetermined movement direction, a platen that extends in a predetermined movement direction and supports the medium is arranged. Also, a gap between a recording head and a platen which is provided in a lower portion of a carriage is maintained to be a proper distance so that a recording quality of the medium are maintained.

However, the recording apparatus is made to be small and lightweight so as to be easily carried, compared with the stationary recording apparatus. Therefore, compared with the stationary recording apparatus, the rigidity of the apparatus is easily reduced. In addition, when the recording apparatus is used at the place to which the notebook computer is carried, the recording apparatus is laid on a small object (for example, a pen) positioned on a mounting surface on which the recording apparatus is mounted.

In this case, deflection is generated on the platen, and thus the gap between the recording head and the platen changes, so that the recording quality may be decreased.

SUMMARY

An advantage of some aspects of the invention is to suppress the change of the gap in the ink jet recording apparatus, and to reduce the decrease of the recording quality of the medium.

According to an aspect of the invention, there is provided an ink jet recording apparatus, including: a case; a recording head that performs recording by ejecting liquid to a medium provided in the case; a base portion provided in a position that faces the recording head and has a medium supporting portion that supports the medium; a protruding portion that is provided in any one of an area facing a bottom portion of the case in the base portion or an area facing the base portion in the bottom portion in the case, protrudes to the other one, and extends in a first direction intersecting a transportation direction of the medium; and a receiving portion that is provided in any one of an area facing the bottom portion of the case in the base portion and an area facing the base portion in the bottom portion of the case, and receives the protruding portion.

In this case, the protruding portion that is provided in any one of an area facing a bottom portion of the case in the base portion or an area facing the base portion in the bottom portion in the case, protrudes to the other one is received by the receiving portion provided in any one of an area facing the bottom portion of the case in the base portion and an area facing the base portion in the bottom portion of the case. Therefore, deflection of the base portion in the apparatus height direction is suppressed by the protruding portion and the receiving portion and the change of the gap between the recording head and the base portion can be suppressed, and thus the decrease of the recording quality of the medium can be reduced.

In the ink jet recording apparatus, a discharge roller shaft provided with a discharge roller discharging a medium may be shaft-supported by the base portion.

In this case, the protruding portion suppresses the deflection of the base portion and thus deflection of the discharge roller shaft can be suppressed. Therefore, the decrease of the discharging properties of the medium in the ink jet recording apparatus can be suppressed. In addition, since the protruding portion suppresses the deflection of the base portion, the change of the gap between the recording head and the base portion can be suppressed, and thus the decrease of the recording quality of the medium can be reduced.

In the ink jet recording apparatus, the discharge roller shaft may be provided at a position corresponding to the protruding portion or the receiving portion in the transportation direction of the medium.

In this case, since the discharge roller shaft is provided near the protruding portion, the deflection of the discharge roller shaft can be further suppressed.

In this case, a portion of at least one of the protruding portion and the receiving portion is overlapped with at least a portion of the storing chamber in the second direction intersecting the transportation direction of the medium. If the second direction is, for example, the apparatus height direction, the increase of the apparatus in size in the apparatus height direction can be suppressed, compared with the configuration in which the protruding portion is provided over the storing chamber.

In the ink jet recording apparatus, the storing chamber may include a first storing chamber and a second storing chamber, the first storing chamber stores a waste liquid absorbing body that absorbs waste liquid led to a lower side of the base portion, the second storing chamber detachably stores a cartridge that maintains the waste liquid delivered by a pump provided in the case, and the first storing chamber and the second storing chamber are arranged in parallel in the transportation direction of the medium on the lower side of the base portion.

In this case, since the first storing chamber and the second storing chamber are arranged by using the area on the lower side of the base portion, the miniaturization of the apparatus can be achieved.

In the ink jet recording apparatus, the receiving portion may formed between a side wall formed on at least one of the first storing chamber and the second storing chamber and a side wall of the case.

In the ink jet recording apparatus, the protruding portion may be positioned between the storing chamber and a side surface of the case positioned on the lower stream side of the storing chamber in the transportation direction of the medium, in the transportation direction of the medium.

In the ink jet recording apparatus, the protruding portion may come close to the side surface of the case in the case.

In this case, by causing the protruding portion to come close to the apparatus front surface, the discharge roller shaft supported by base portion can be caused to come close to the front surface of the apparatus in a state in which the deflection is suppressed. Accordingly, the medium can be discharged to the apparatus front surface by the discharge roller, without being caught by the apparatus main body. Accordingly, the discharging properties of the medium in the ink jet recording apparatus can be enhanced.

The ink jet recording apparatus may further includes a transporting roller that transports a medium to the recording head and that is provided on the upper stream side of the recording head in the transportation direction of the medium, and in which the base portion may support at least one portion of a rotation shaft of the transporting roller in an axial direction of the rotation shaft.

In this case, since the base portion supports at least one portion of the rotation shaft of the transporting roller, the protruding portion suppresses the deflection of the base portion, the deflection of the rotation shaft of the transporting roller can be suppressed, and thus the decrease of the transportation property of the medium in the ink jet recording apparatus can be suppressed. In addition, since the protruding portion suppresses the deflection of the base portion, the change of the gap between the recording head and the base portion can be suppressed, and thus the decrease of the recording quality of the medium is reduced.

The ink jet recording apparatus may further include a transporting roller that transports a medium to the recording head and that is provided on the upper stream side of the recording head in the transportation direction of the medium; a driving source that is provided on an upper stream side of the base portion in the transportation direction; and a driving force transmitting mechanism that includes plural gear wheels arranged from the upper stream side to the lower stream side in the transportation direction of the medium and transmits a driving force to the transporting roller and the discharge roller from the driving source.

In this case, since the transporting roller and the discharge roller are driven by one driving force transmitting mechanism, plural driving mechanisms are not required in order to respectively drive the transporting roller and the discharge roller, and thus the configuration of the apparatus can be simplified, and also the increase of the apparatus in size can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
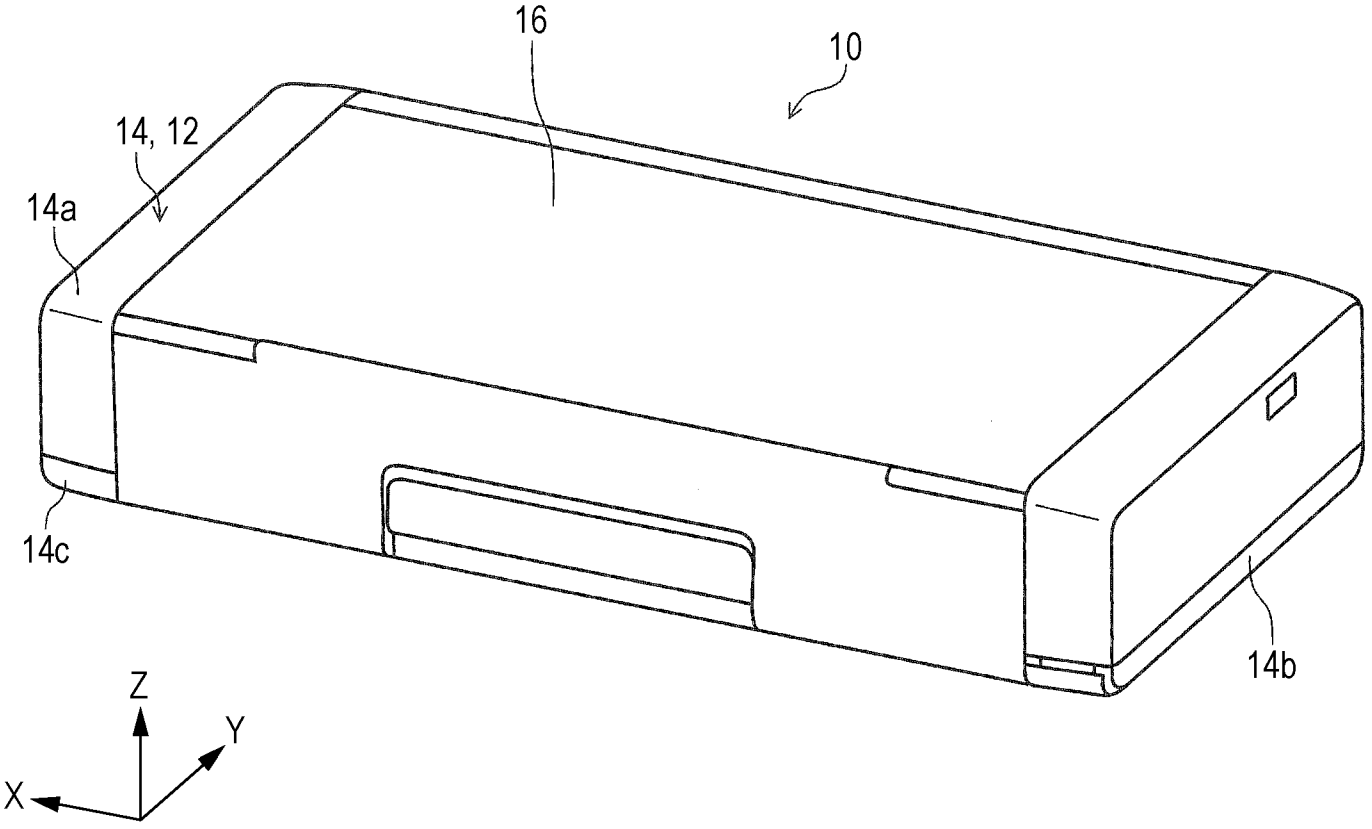
FIG. 1 is an external perspective view illustrating a state in which a cover is in a closed state in a printer according to the invention.

Hereinafter, exemplary embodiments of the invention are described with reference to the drawings. Further, the same configurations are denoted by the same reference numerals, and the configurations are described in a first exemplary embodiment, and the descriptions of the configurations are omitted in the subsequent exemplary embodiments.

Figure 2:
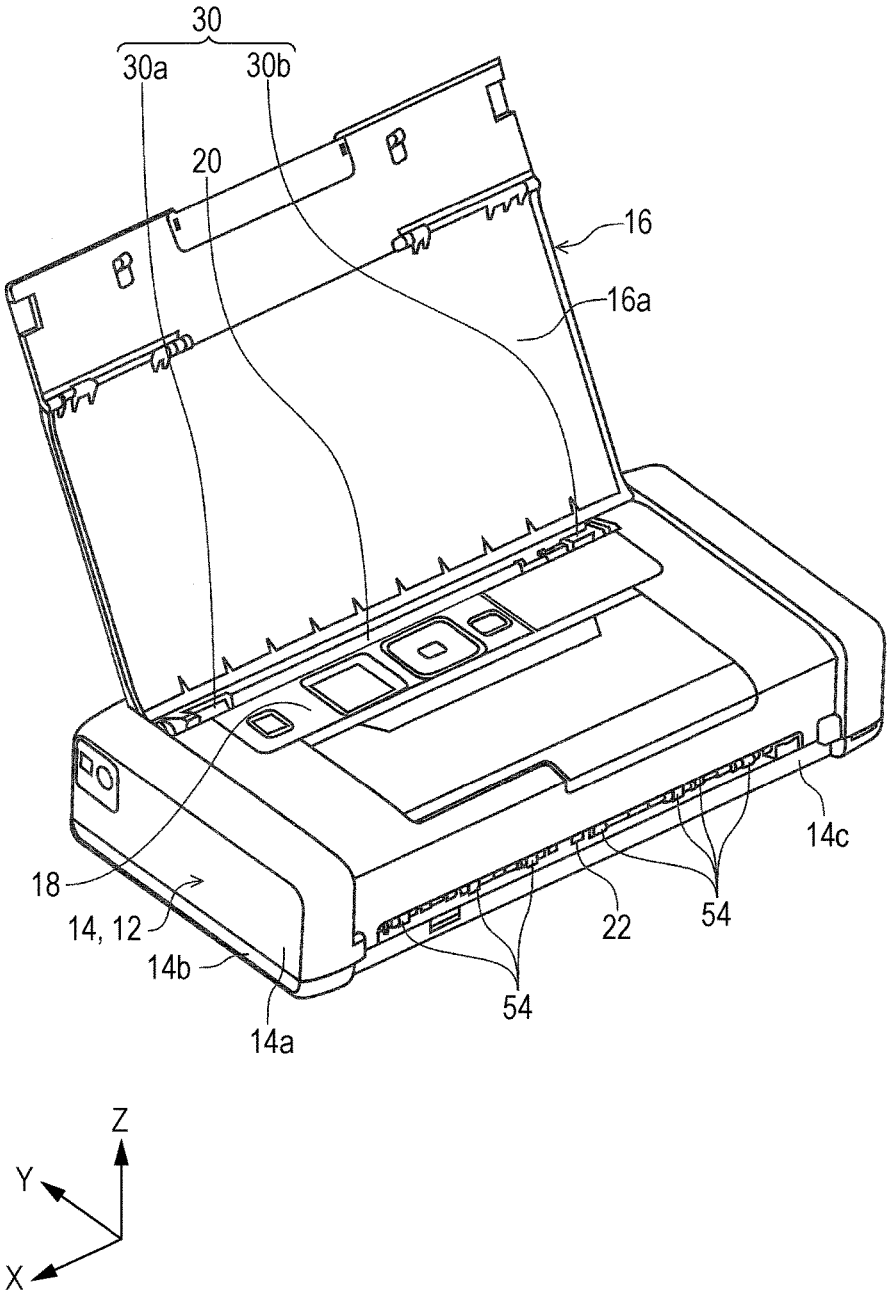
FIG. 2 is an external perspective view illustrating a state in which a cover is in an open state in the printer according to the invention.
Figure 3:
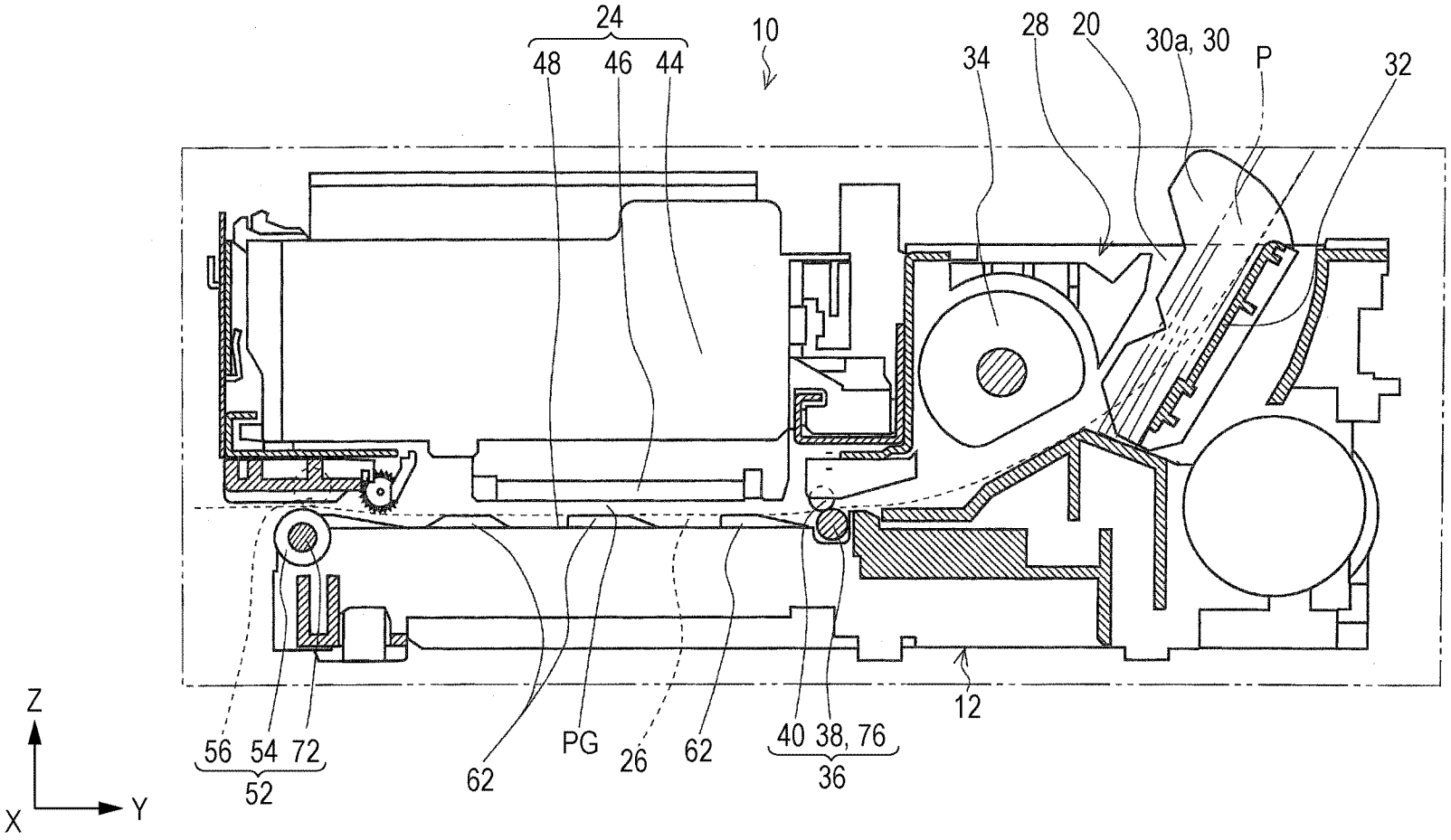
FIG. 3 is a cross-sectional view illustrating a transportation path of the medium in the printer according to the invention.
Figure 4:
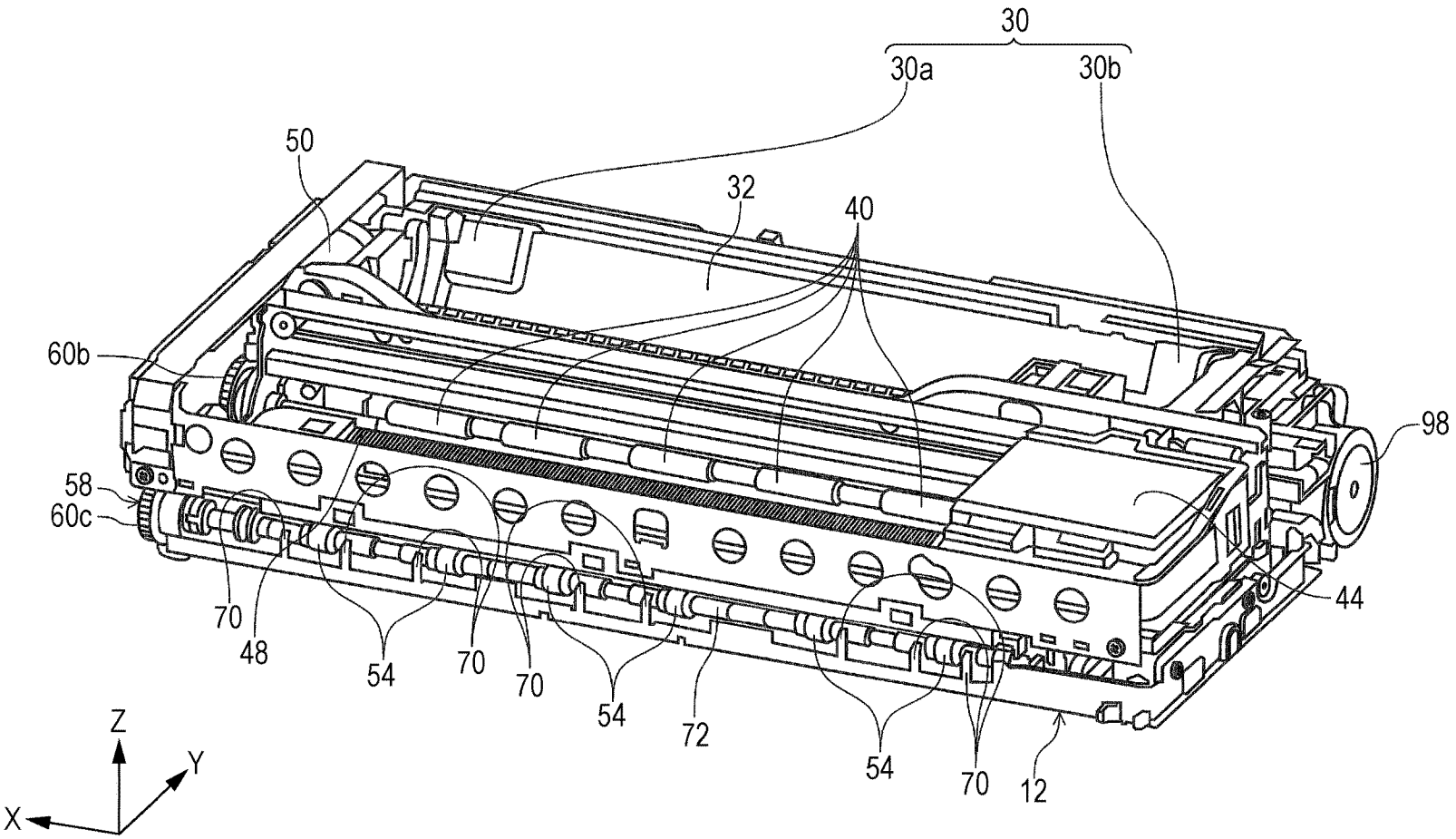
FIG. 4 is an external perspective view illustrating an apparatus main body of the printer according to the invention.
Figure 5:
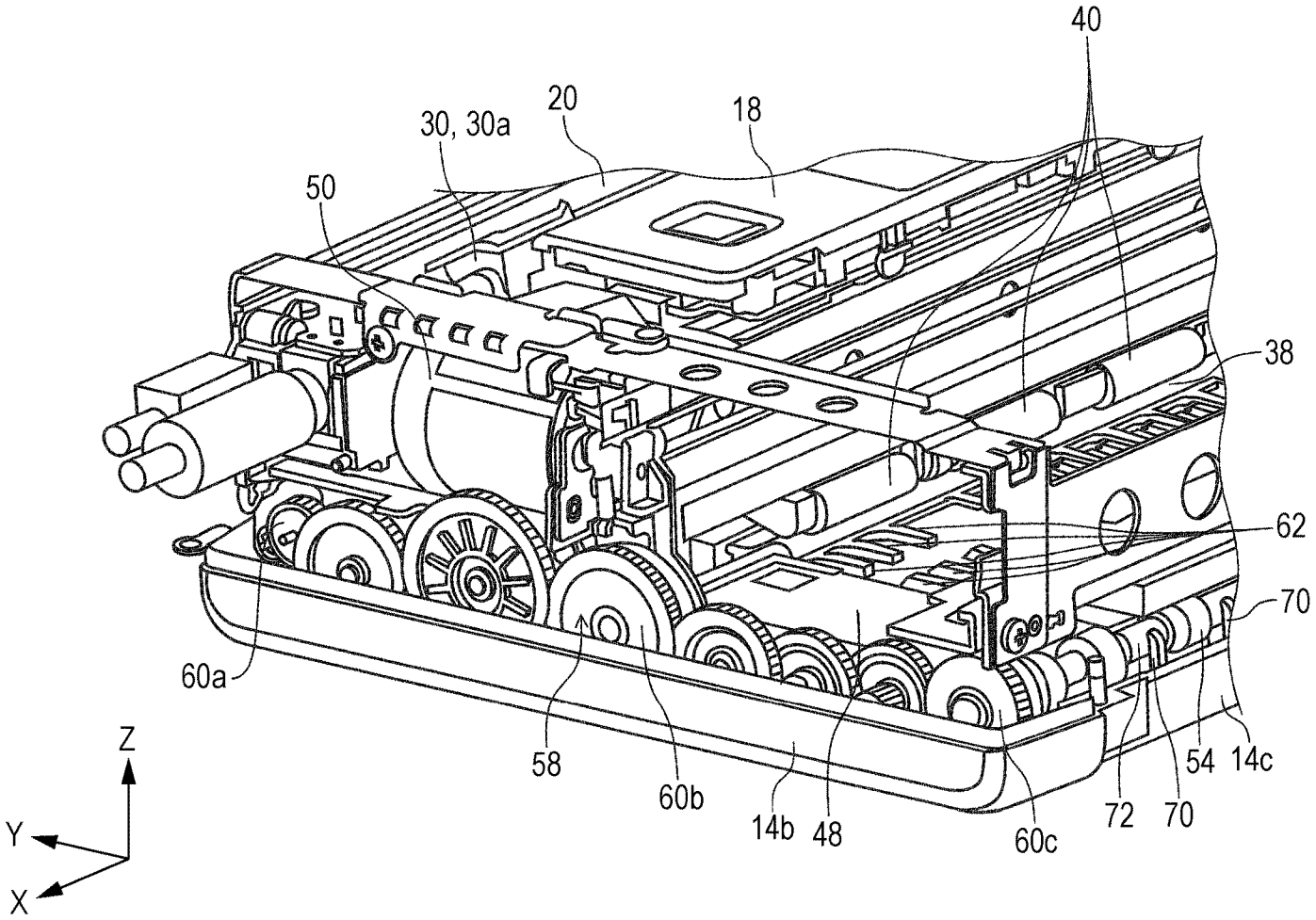
FIG. 5 is a perspective view illustrating a driving force transmitting mechanism provided in the apparatus main body.

FIG. 1 is an external perspective view illustrating a state in which a cover is in a closed state in a printer according to the invention, FIG. 2 is an external perspective view illustrating a state in which a cover is in an open state in the printer according to the invention, FIG. 3 is a cross-sectional view illustrating a transportation path of a medium in the printer according to the invention, FIG. 4 is an external perspective view illustrating an apparatus main body of the printer according to the invention, and FIG. 5 is a perspective view illustrating a driving force transmitting mechanism provided in the apparatus main body.

Figure 6:
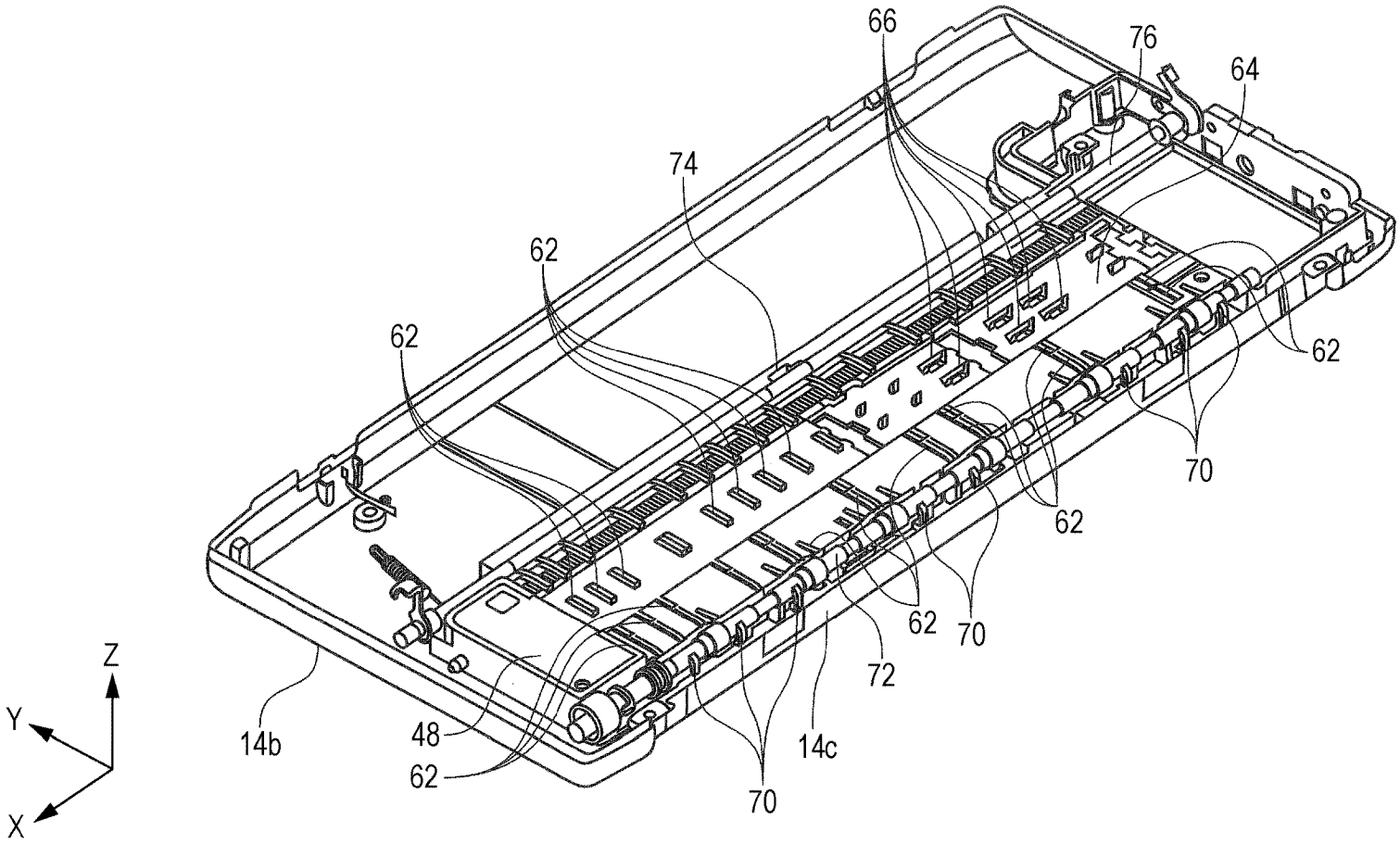
FIG. 6 is a perspective view illustrating a platen in a state of being provided in a lower housing.
Figure 7:
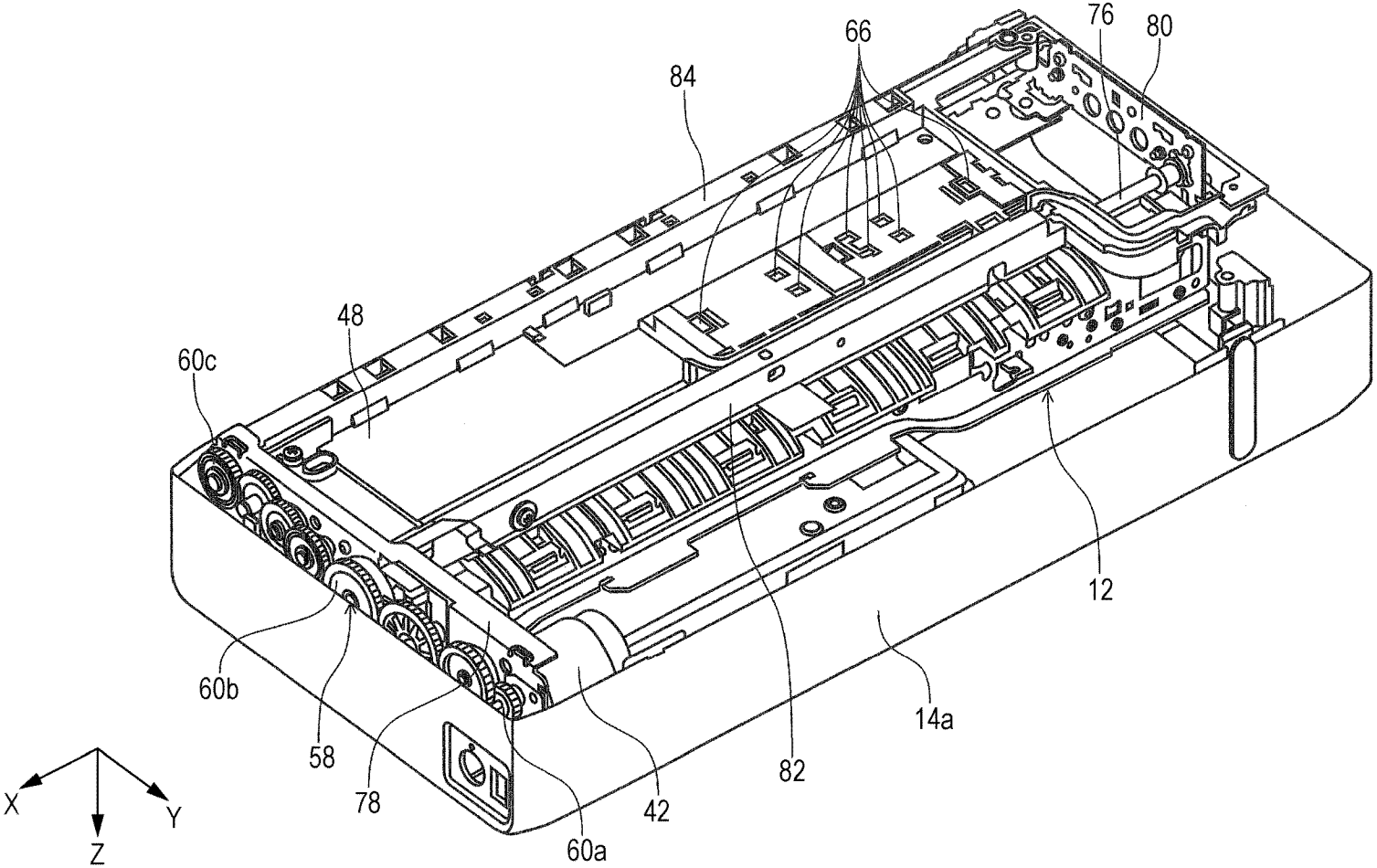
FIG. 7 is a perspective view illustrating the platen seen from the lower side in a state of being provided in the apparatus main body.
Figure 8:
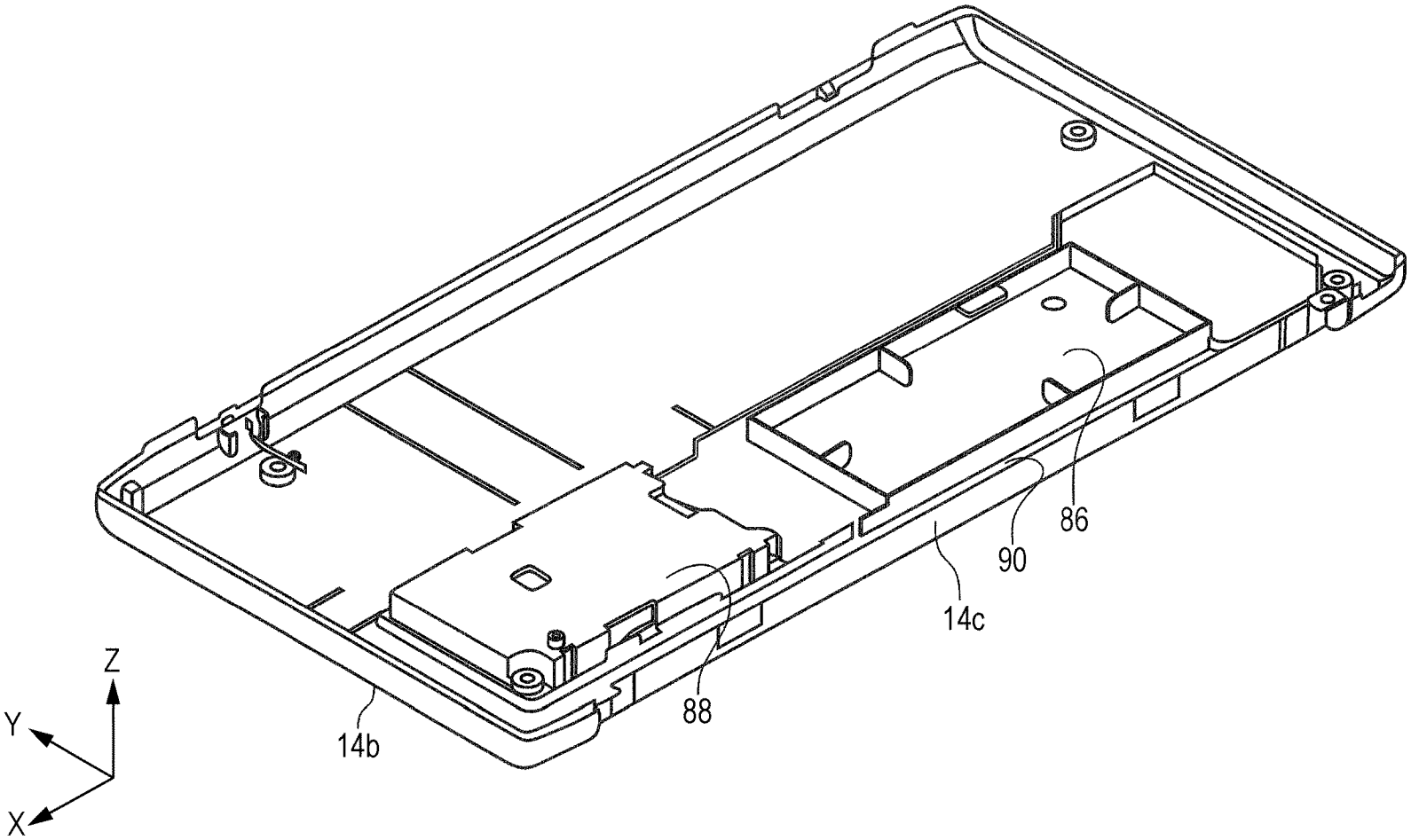
FIG. 8 is a perspective view illustrating the lower housing.
Figure 9:
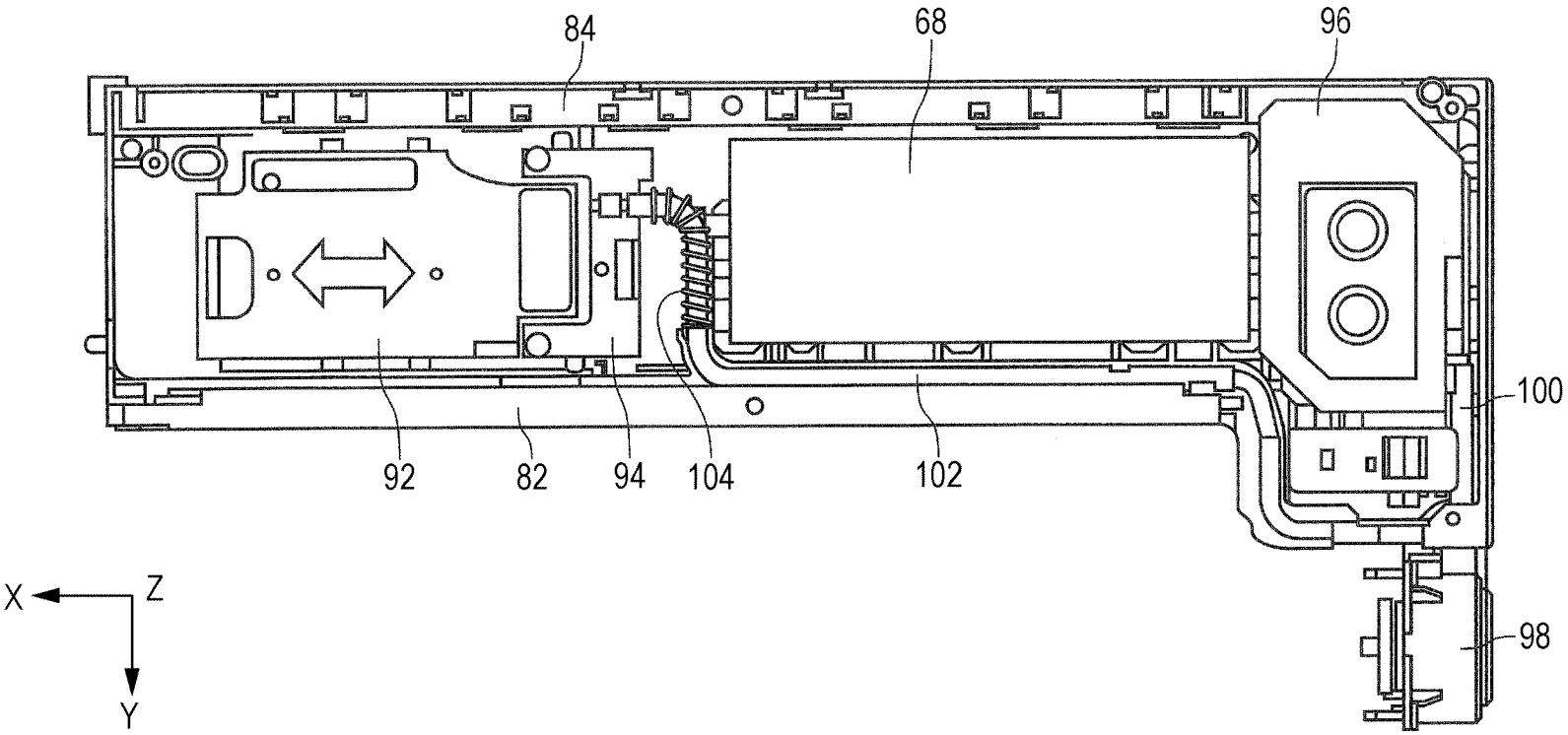
FIG. 9 is a plan view illustrating the platen and a cap seen from the lower side.
Figure 10:
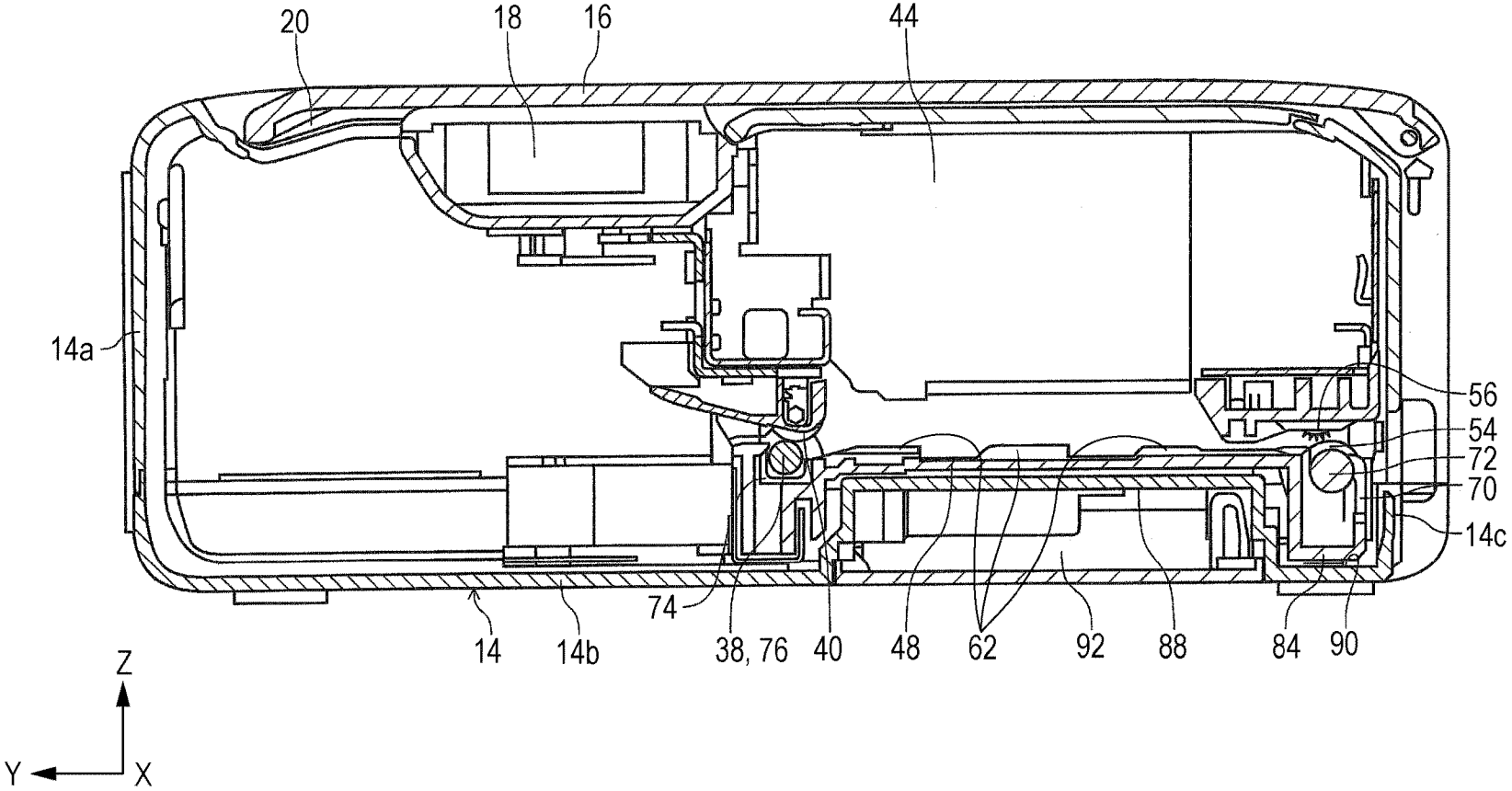
FIG. 10 is a sectional view illustrating the printer according to the invention.

FIG. 6 is a perspective view illustrating a platen in a state of being provided in a lower housing, FIG. 7 is a perspective view illustrating the platen seen from the lower side in a state of being provided in the apparatus main body, FIG. 8 is a perspective view illustrating the lower housing, FIG. 9 is a plan view illustrating the platen and a cap seen from the lower side, and FIG. 10 is a sectional view illustrating the printer according to the invention.

In addition, in X-Y-Z coordinate systems illustrated in the respective drawings, the X direction as a "first direction" indicates a scanning direction of a recording head and a width direction of an ink jet recording apparatus, the Y direction indicates a transportation direction of a medium and a depth direction of the ink jet recording apparatus, and the Z direction as the "second direction" indicates a direction in which the distance (gap) between the recording head and the medium changes, that is, the direction of the height of the ink jet recording apparatus. Further, in the respective drawings, the −X direction side is set to be a home position side, the −Y direction is set to be an apparatus front surface side, the +Y direction side is set to be an apparatus back surface side, the +Z axis direction side is set to be an apparatus upward side, and the −Z axis direction side is set to be an apparatus downward side.

Concept of Printer

With reference to FIGS. 1 and 2, components of an ink jet printer 10 (hereinafter, referred to as the "printer 10") are described as examples of a recording apparatus. The printer 10 includes an apparatus main body 12 (see FIG. 4), a housing 14 that covers the circumference of the apparatus main body 12, forms an exterior of the printer 10, and is used as a "case", a cover 16 that can open or close the apparatus main body 12, and an operating portion 18 that is exposed on the upper portion of the apparatus main body 12 when the cover 16 is in an open state. In addition, the housing 14 includes an upper housing 14*a* and a lower housing 14*b* that forms a "bottom portion of the case".

The cover 16 forms a portion of the upper surface and the front surface of the printer 10 in a closed state. The cover 16 is rotatably attached to the apparatus main body 12. The cover 16 rotates from the apparatus frontward side (−Y axis direction in FIG. 2) to the apparatus rearward side (+Y axis direction in FIG. 2) with respect to the apparatus main body 12 in the counter-clockwise direction in FIG. 2, so that the cover becomes in the open state as illustrated in FIG. 2. In the exemplary embodiment, when the cover 16 is in the open state to the apparatus main body 12 as illustrated in FIG. 2, the inner surface of the cover 16 functions as a mounting surface 16*a* of paper P as a "medium".

In addition, if the cover 16 is changed from the closed state (see FIG. 1) to the open state as illustrated in FIG. 2, the operating portion 18 and a paper supplying opening 20 are exposed on the upper portion of the apparatus main body 12, and a discharging opening 22 is exposed on the front surface of the apparatus main body 12. The operating portion 18 is formed to include a power button, a print setting button, a display panel or the like for operating the printer 10.

In addition, when the paper P is mounted on the mounting surface 16*a* of the cover 16, the paper supplying opening 20 supplies the paper P from the mounting surface 16*a* to the inside of the apparatus main body 12. In addition, the discharging opening 22 accepts that the paper P that is supplied from the mounting surface 16*a* to the inside of the apparatus main body 12 via the paper supplying opening 20 is discharged to the apparatus front surface side (−Y axis direction side in FIG. 2) in a state in which the recording is performed by a recording portion 24 described below.

Concept of Paper Transportation Path

Subsequently, with reference to FIGS. 3 and 4, components on the paper transportation path are described in detail. In FIG. 3, the right side of FIG. 3 (apparatus back surface side) is the upper stream of the transportation path, and the left side of FIG. 3 (apparatus front surface side) is the lower stream of the transportation path. In addition, a broken line denoted by a reference number 26 in FIG. 3 indicates a transportation path of the paper P.

A paper supplying portion 28 that feeds the paper from the mounting surface 16*a* of the cover 16 in the open state to the housing 14 to the lower stream side of the transportation path is provided on the upper stream side of the transportation path. The paper supplying portion 28 includes the paper supplying opening 20, a pair of paper guides 30 provided on the paper supplying opening, a paper supporting portion 32 that supports at least a portion of the paper introduced from the paper supplying opening 20, and a feeding roller 34 that is provided at a position that faces the paper supporting portion 32. Further, the cover 16 and the paper supporting portion 32 support the paper P in an inclined state.

The pair of paper guides 30 includes a paper guide 30*a* that is positioned on the +X axis direction side in the X axis direction of FIGS. 2, 4, and 5, and a paper guide 30*b* that is positioned on the −X axis direction side. The paper guide 30*a* is movably formed to come close to or be separate from the paper guide 30*b* positioned on the −X axis direction side in the X axis direction. That is, the paper guide 30*a* is provided so as to be slidably operated by the user in the paper width direction (X direction).

The paper supporting portion 32 is formed in an inclined manner so as to be declined on the −Y direction side in FIG. 3. In addition, the feeding roller 34 is formed swingably in a separating detection of the paper P mounted on the paper supporting portion 32. When the feeding roller 34 displaces in the direction of coming close to the paper supporting portion 32, the feeding roller 34 comes close to the paper P mounted on the paper supporting portion 32 in the highest position, and feeds the paper P in the highest position on the lower stream side of the transportation path.

A transportation portion 36 is provided on the lower stream side of the paper supplying portion 28. The transportation portion 36 includes a transportation driving roller 38 as a "transporting roller", and a transportation driven roller 40. The transportation driving roller 38 is rotatably driven by a driving motor 42 (see FIG. 7). The transportation portion 36 nips the paper P fed from the paper supplying portion 28 with the transportation driving roller 38 and the transportation driven roller 40 and transports the paper P to the lower stream side in the transportation direction. The recording portion 24 is provided on the lower stream side of the transportation portion 36.

The recording portion 24 includes a carriage 44, a recording head 46 provided on the bottom portion of the carriage, and a platen 48 as the "base portion" which faces the base portion and supports the medium. The recording head 46 faces the paper P supported by the platen 48. The carriage 44 is driven to reciprocate in the apparatus width direction (X axis direction in FIG. 4) by a carriage driving motor 50 (see FIG. 4) controlled by a control portion (not illustrated) provided inside the apparatus main body 12. In addition, the platen 48 regulates a distance (gap) PG between the recording surface of the medium and the head surface of the recording head 46 by supporting the paper P from the lower side.

When the paper P supported by the platen 48 faces the recording head 46 in the recording portion 24, the recording is performed by ejecting the ink to the paper P from plural nozzle holes (not illustrated) of the recording head 46, and causing the ink to impact on the recording surface of the paper P (surface facing the recording head 46).

A discharging portion 52 is provided on the lower stream side in the transportation direction of the recording portion 24. The discharging portion 52 includes discharge driving rollers 54 as "discharge rollers" and a discharging driven roller 56. The paper P on which recording is performed by the recording portion 24 is nipped by the discharge driving rollers 54 and the discharging driven roller 56 and is discharged from the discharging opening 22 formed on the apparatus front surface to the apparatus frontward side. In addition, the discharge driving rollers 54 are rotatably driven by the driving motor 42 (see FIG. 7). Further, the driving motor 42 (see FIG. 7) and the carriage driving motor 50 (see FIG. 4) are controlled by the control portion (not illustrated).

With Respect to Driving Force Transmitting Mechanism

Here, a driving force transmitting mechanism 58 is described with respect to FIGS. 5 to 7. As illustrated in FIG. 5, the driving force transmitting mechanism 58 is provided on the apparatus bottom surface side (−Z axis direction side in FIG. 5) in the end portion on the opposite side (+X axis direction in FIG. 5) of the home position in the apparatus width direction of the apparatus main body 12. The driving force transmitting mechanism 58 includes plural gear wheels.

In addition, as illustrated in FIG. 7, the driving motor 42 is provided in the end portion (end portion on the +X axis direction side) opposite to the home position in the apparatus width direction, on the back surface side (+Y axis direction side in FIG. 7) of the apparatus main body 12.

The driving force transmitting mechanism 58 drives the transportation driving roller 38 by transmitting the driving force of the driving motor 42 provided on the back surface side of the apparatus main body 12 (+Y axis direction side in FIG. 7) from a gear wheel 60*a* attached to the driving shaft of the driving motor 42 to a gear wheel 60*b* that drives the transportation driving roller 38 via plural gear wheels. Further, the discharge driving rollers 54 are driven by transmitting the driving force of the driving motor 42 from the gear wheel 60*b* via plural gear wheels to a gear wheel 60*c* positioned on the front surface side of the apparatus main body 12 (−Y axis direction side in FIG. 5).

That is, the driving force transmitting mechanism 58 is formed as a driving force transmitting mechanism that transmits the driving force of the driving motor 42 to the transportation driving roller 38 and the discharge driving rollers 54 which are transporting sections that transport the paper P.

That is, according to the exemplary embodiment, since the transportation driving roller 38 and the discharge driving rollers 54 are driven by one driving force transmitting mechanism 58, plural driving mechanisms are not required in order to drive the transportation driving roller 38 and the discharge driving rollers 54, respectively. Therefore, the configuration of the printer 10 can be simplified, and the increase of the printer 10 in size can be suppressed.

With Respect to Configurations of Platen and Lower Housing

The configurations of the platen 48 and the lower housing 14*b* are described with reference to FIGS. 6 to 10. As illustrated in FIG. 6, the platen 48 is attached to the lower housing 14*b*. In addition, plural ribs 62 as "medium supporting portions" that support the paper P are provided on the upper surface of the platen 48 to have intervals in the apparatus width direction (X axis direction in FIG. 6) and the apparatus depth direction (Y axis direction in FIG. 6) which is a transportation direction of the paper.

In addition, a concave portion 64 is provided in a portion of an area in the apparatus width direction of the platen 48 (X axis direction in FIG. 6), and an ink absorbing body (not illustrated) is disposed in the concave portion 64. When borderless recording is performed on the paper P in the printer 10, the ink absorbing body absorbs the ink deviated and discarded from the end portion of the paper P. In the exemplary embodiment, the concave portion 64 is provided near the end portion on the home position side (−X axis direction side in FIG. 6) in the apparatus width direction (X axis direction in FIG. 6), that is the direction intersecting the transportation direction of the paper P (Y axis direction in FIG. 6).

Here, in the printer 10, the paper P on which recording can be performed includes L-sized photographic paper, a postcard, or the like, in addition to plain paper. According to the exemplary embodiment, the printer 10 is formed so that borderless recording in which recording is performed on the entire surface of the recording surface of paper of a small size of L-sized photographic paper, a postcard, or the like (hereinafter, referred to as a "small size paper") can be performed.

In addition, according to the exemplary embodiment, lengths of the concave portion 64 and the ink absorbing body (not illustrated) arranged in the concave portion 64 in the apparatus width direction (X axis direction in FIG. 6) are set to be lengths in which the borderless recording on the small size paper can be performed in the printer 10. That is, the lengths are set so that the concave portion 64 and the ink absorbing body arranged in the concave portion 64 are positioned in an area deviated from the end portion of the small size paper.

In addition, plural holes 66 (see FIGS. 6 and 7) are provided on the bottom surface of the concave portion 64. The ink temporarily stored in the ink absorbing body arranged in the concave portion 64 moves to the lower side of the platen 48 via the holes 66, and is absorbed in an ink absorbing body 68 described below which is positioned in the lower portion of the platen 48.

In addition, plural bearings 70 are provided in the apparatus width direction (X axis direction in FIG. 6) on the apparatus front surface side (−Y axis direction side in FIG. 6) on the upper surface side of the platen 48, that is on the side that can face the recording head 46 (+Z axis direction side in FIG. 6). The bearings 70 support a discharge roller shaft 72 to which the discharge driving rollers 54 is attached.

According to the exemplary embodiment, since the plural bearings 70 are provided on the platen 48 in the apparatus width direction (X axis direction in FIG. 6) which is the first direction, the discharge roller shaft 72 can be supported by plural portions so that deflection of the discharge roller shaft 72 can be further reduced.

In addition, a bearing 74 is provided in at least one portion on the apparatus back surface side (+Y axis direction side in FIG. 6), that is, on the upper stream of the recording head 46 in the paper transportation path, on the upper surface side of the platen 48. The bearing 74 supports a rotation shaft 76 of the transportation driving roller 38. In addition, both end portions of the rotation shaft 76 are supported by frames 78 and 80 (see FIG. 7) that form the apparatus main body 12. That is, according to the exemplary embodiment, the rotation shaft 76 is internally supported by the bearing 74.

Subsequently, with reference to FIGS. 7 and 8, a reinforcing member 82 extending in the apparatus width direction (X axis direction in FIG. 7) is attached to the end portion of the apparatus back surface side (+Y axis direction side in FIG. 7) on the lower surface side of the platen 48. According to the exemplary embodiment, the reinforcing member 82 is formed of a highly rigid material, for example, a metal material. The reinforcing member 82 suppresses deflection of the platen 48 in the apparatus width direction (X axis direction in FIG. 7). Accordingly, the gap PG between the recording head 46 and the platen 48 can be maintained to a constant distance.

In addition, a protruding portion 84 is provided in the end portion of the apparatus front surface side (−Y axis direction side in FIG. 7) on the lower surface side of the platen 48. The protruding portion 84 protrudes from the lower surface of the platen 48 to the lower side (−Z axis direction side in FIG. 7) in the apparatus height direction. In addition, the protruding portion 84 extends on the lower surface of the platen 48 in the apparatus width direction (X axis direction in FIG. 7).

In addition, the discharge roller shaft 72 is supported at a position corresponding to the protruding portion 84 in the apparatus depth direction which is the transportation direction of the paper P. Further, according to the exemplary embodiment, the "position corresponding to the protruding portion 84" is not limited to a portion right above the protruding portion 84, but includes a portion deviated from the position right above the protruding portion 84 to the upper stream side or the lower stream side in the transportation direction of the paper P. Accordingly, the deflection of the discharge roller shaft 72 can be further suppressed by providing the discharge roller shaft 72 near the protruding portion 84.

In addition, according to the exemplary embodiment, since the platen 48 supports the rotation shaft 76 of the transportation driving roller 38 from at least one portion, the protruding portion 84 suppresses the deflection of the platen 48, and also deflection of the rotation shaft 76 of the transportation driving roller 38 can be suppressed. Therefore, the decrease of the transportation properties of the paper P in the printer 10 can be suppressed.

Subsequently, with reference to FIG. 8, a first storing chamber and a second storing chamber as storing chambers are provided on the lower side area of the platen 48 of the lower housing 14*b*. Specifically, a concave portion 86 as a "first storing chamber" and a waste ink cartridge storing chamber 88 as a "second storing chamber" are provided on the lower side area of the platen 48. Also, the concave portion 86 and the waste ink cartridge storing chamber 88 are provided in parallel in the apparatus depth direction which is the transportation direction of the paper P, in the lower side area of the platen 48.

In addition, a receiving portion 90 is provided between a front surface 14*c* of the lower housing 14*b* as a "side surface of the case" and a portion including the concave portion 86 and the waste ink cartridge storing chamber 88 in the apparatus depth direction. That is, the receiving portion 90 is provided between a side surface formed on the apparatus front surface side in the apparatus depth direction of any one of the concave portion 86 and the waste ink cartridge storing chamber 88 and the front surface 14*c* of the lower housing 14*b*. The receiving portion 90 is formed to extend in the apparatus width direction (X axis direction in FIG. 8). Also, as illustrated in FIG. 10, when the platen 48 is attached to the lower housing 14*b*, the protruding portion 84 is received by the receiving portion 90. In addition, as illustrated in FIG. 10, the protruding portion 84 is arranged near the front surface 14*c*.

Accordingly, according to the exemplary embodiment, since the protruding portion 84 that is provided on the lower surface side of the platen 48 and protrudes toward the lower housing 14*b* is received by the receiving portion 90 provided in the lower housing 14*b*, the increase of the apparatus in size in the apparatus height direction can be suppressed. In addition, since the protruding portion 84 extending in the apparatus width direction (X axis direction in FIG. 7) is provided in the platen 48, the deflection of the platen 48 in the apparatus height direction (Z axis direction in FIG. 7) can be suppressed, the change of the gap PG between the recording head 46 and the platen 48 can be suppressed, and the decrease of the paper P in the recording quality can be reduced.

In addition, if the protruding portion 84 suppresses the deflection of the platen 48, the deflection of the discharge roller shaft 72 supported by the platen 48 can be suppressed. Therefore, the decrease of the discharging properties of the paper P in the printer 10 can be suppressed.

According to the exemplary embodiment, by causing the protruding portion 84 to come close to the front surface 14*c* of the lower housing 14*b*, the discharge roller shaft 72 supported by the platen 48 also can be caused to be come close to the front surface 14*c* of the lower housing 14*b* in a state in which the deflection is suppressed. Accordingly, the paper P can be discharged to the front surface 14*c* side by the discharge driving rollers 54 without being caught by the apparatus main body 12. Accordingly, the discharging properties of the paper P in the printer 10 can be enhanced.

Here, with reference to FIGS. 8 and 9, the ink absorbing body 68 can be stored in the concave portion 86. According to the exemplary embodiment, after the ink is discarded, when borderless recording is performed on small size paper and is once absorbed in the ink absorbing body (not illustrated) arranged in the concave portion 64 on the upper surface side of the platen 48, the ink is led from the upward side of the platen 48 to the lower side via the plural holes 66, and is absorbed and maintained in the ink absorbing body 68. Further, according to the exemplary embodiment, the ink absorbing body 68 and the ink absorbing body arranged in the concave portion 64 on the upper surface side of the platen 48 are formed with sponge members.

In addition, in the waste ink cartridge storing chamber 88 provided on the back surface of the lower housing 14*b*, a waste ink cartridge 92 is detachably attached. A cartridge connecting portion 94 illustrated in FIG. 9 is provided in the waste ink cartridge storing chamber 88. The waste ink cartridge 92 is detachably formed in the cartridge connecting portion 94. Further, in FIG. 9, the waste ink cartridge storing chamber 88 is not illustrated for description.

In addition, in the apparatus main body 12, in the end portion on the home position side (−X axis direction side in FIG. 9) in the apparatus width direction, a cap section 96 and a pump 98 are provided. The cap section 96 and the pump 98 are connected to each other via a waste ink tube 100.

When the carriage 44 is positioned in the home position, the cap section 96 faces the recording head 46 and is pushed onto a nozzle formed surface (not illustrated) of the recording head 46, so that the nozzle formed surface can be sealed and the drying of the ink can be prevented. In addition, the cap section 96 is formed to be in a sealed state of being pushed onto the recording head 46 and a separate state of being separate from the recording head 46.

In addition, when the cap section 96 seals the recording head 46, negative pressure occurs in the cap section 96 via the waste ink tube 100 by driving the pump 98. By the negative pressure, ink is sucked by nozzles of the recording head 46 so that clogging of the nozzles can be prevented and the mixture of bubbles can be dissolved.

In addition, a flushing operation is performed at a constant timing when the recording operation is performed in the printer 10. The flushing operation temporarily moves the carriage 44 to the home position, and causing the ink to be ejected and discarded to the cap section 96.

The waste ink generated in the cap section 96 is sucked via the waste ink tube 100 by the pump 98. Here, the pump 98 and the cartridge connecting portion 94 are connected via a waste ink tube 102. Also, the sucked waste ink is stored and maintained in the waste ink cartridge 92 via the cartridge connecting portion 94 connected to the waste ink tube 102 extending from the pump 98.

Further, with respect to the waste ink tube 102 connected to the pump 98 and the cartridge connecting portion 94, a spring member 104 is attached to an end portion on the cartridge connecting portion 94 side. The spring member 104 can suppress the bending of the waste ink tube 102 so as to prevent the passage in the waste ink tube 102 from collapsed.

Here, as illustrated in FIGS. 8 to 10, the concave portion 86 in which the ink absorbing body 68 is arranged and the waste ink cartridge storing chamber 88 in which the waste ink cartridge 92 is stored are positioned between the reinforcing member 82 and the protruding portion 84 in the lower side area of the platen 48 in the apparatus depth direction which is the transportation direction of the paper P in a state in which the platen 48 is attached to the lower housing 14*b*.

Also, as illustrated in FIG. 10, in the apparatus height direction (Z axis direction in FIG. 10), the waste ink cartridge storing chamber 88 and at least a portion of an area in which any one of the concave portion 86 is provided and the protruding portion 84 are overlapped. Accordingly, the increase of the printer 10 in size can be suppressed in the apparatus height direction, compared with the configuration in which the protruding portion 84 is provided over the concave portion 86 and the waste ink cartridge storing chamber 88 in the apparatus height direction.

In addition, according to the exemplary embodiment, since the concave portion 86 and the waste ink cartridge storing chamber 88 are arranged by using the area on the lower side of the platen 48, the miniaturization of the printer 10 can be achieved.

Modification of Exemplary Embodiment (1) According to the exemplary embodiment, the protruding portion 84 is provided on the platen 48, and the receiving portion 90 is provided on the lower housing 14*b*. However, instead of this configuration, the protruding portion 84 may be provided on the lower housing 14*b*, and the receiving portion 90 may be provided on the platen 48.

(2) According to the exemplary embodiment, on the lower surface of the platen 48, the reinforcing member 82 is provided in the end portion on the upper stream side in the transportation direction of the paper P, and the protruding portion 84 is provided in the end portion on the lower stream side in the transportation direction. However, instead of this configuration, the protruding portion 84 may be provided in the end portion on the upper stream side in the transportation direction of the paper P, and the reinforcing member 82 may be provided in the end portion on the lower stream side in the transportation direction.

The description above can be summarized as follows. According to the exemplary embodiment, the printer 10 includes the housing 14, the recording head 46 that performs recording on the paper P provided in the housing 14, the platen 48 that has the ribs 62 that are provided at a position that can face the recording head 46 and support the paper P, the protruding portion 84 that is provided at any one of an area that faces the lower housing 14*b* of the housing 14 in the platen 48 or an area that faces the platen 48 in the lower housing 14*b* of the housing 14, protrudes to the other one, and extends in the apparatus width direction which is the first direction intersecting the transportation direction of the paper P, the receiving portion 90 that is provided any one of an area that faces the lower housing 14*b* of the housing 14 in the platen 48 and an area that faces the platen 48 in the lower housing 14*b* of the housing 14 and receives protruding portion 84.

In addition, the discharge roller shaft 72 on which the discharge driving rollers 54 discharges the paper P in the printer 10 is shaft-supported by the platen 48. In addition, the discharge roller shaft 72 is provided at a position corresponding to the protruding portion 84 or the receiving portion 90 in the transportation direction of the paper P.

The storing chambers 86 and 88 that store waste ink generated from the recording head 46 are provided on the back surface of the lower housing 14*b* of the housing 14. Also, a portion of at least one of the protruding portion 84 and the receiving portion 90 and a portion of at least one of the storing chambers 86 and 88 are positioned in the same position in the apparatus height direction that is the second direction intersecting the transportation direction of the paper P.

In the printer 10, the storing chambers 86 and 88 include the concave portion 86 which is the first storing chamber and the waste ink cartridge storing chamber 88 which is the second storing chamber. The concave portion 86 stores the ink absorbing body 68 that absorbs the waste ink which is led to the lower side of the platen 48, and the waste ink cartridge storing chamber 88 detachably stores the waste ink cartridge 92 that maintains the waste ink delivered by the pump 98 provided in the apparatus main body 12. Also, the concave portion 86 and the waste ink cartridge storing chamber 88 are arranged in parallel to the transportation direction of the paper P on the lower side of the platen 48.

The receiving portion 90 is provided between the front surface 14*c* of the housing 14 and the side wall formed on at least any one of the concave portion 86 and the waste ink cartridge storing chamber 88. The protruding portion 84 is positioned in the transportation direction of the paper P between a portion including the concave portion 86 and the waste ink cartridge storing chamber 88 and the front surface 14*c* of the lower housing 14*b* which is positioned on the lower stream side in the transportation direction of the paper P than the concave portion 86 and the waste ink cartridge storing chamber 88. Also, the protruding portion 84 comes close to the front surface 14*c* of the lower housing 14*b* in the housing 14.

The printer 10 includes the transportation driving roller 38 that transports the paper P to the recording head 46 in the transportation direction of the paper P, on the upper stream side of the recording head 46. The platen 48 supports the rotation shaft 76 of the transportation driving roller 38 at least a portion in the axial direction of the rotation shaft 76.

The printer 10 includes the transportation driving roller 38 provided on the upper stream side of the recording head 46 in the transportation direction of the paper P and transports the paper P to the recording head 46, the driving motor 42 that is provided on the upper stream side of the platen 48 in the transportation direction, and the driving force transmitting mechanism 58 that has the plural gear wheels 60*a*, 60*b*, and 60*c* that are arranged from the upper stream side to the lower stream side in the transportation direction of the paper P and transmits the driving force from the driving motor 42 to the transportation driving roller 38 and the discharge driving rollers 54.

In addition, according to the exemplary embodiment, the protruding portion 84 and the receiving portion 90 of the invention are applied to an ink jet printer which is an example of the recording apparatus, but may be generally applied to another liquid ejecting apparatus.

Here, the liquid ejecting apparatus is not limited to a recording apparatus such as a printer, a copying machine, and a facsimile, that uses an ink jet-type recording head, ejects ink from the recording head, and performs recording on a recording medium, and includes an apparatus configured to eject liquid that is used instead of ink and corresponds to the use of ink, from the liquid ejecting head that corresponds to the ink jet-type recording head, to the ejecting medium, and to cause the liquid to be attached to the ejecting medium.

In addition to the recording head, examples of the liquid ejecting head include a coloring material ejecting head that is used in manufacturing color filter such as a liquid crystal display, an electrode material (conductive paste) ejecting head used in forming an electrode such as an organic EL display or a field emission display (FED), a bio-organic material ejecting head used in manufacturing a biochip, and a sample ejecting head used as a precise pipette.

Further, the invention is not limited to the exemplary embodiments above, and various modifications are possible without departing from the scope of the invention. It is obvious that the modifications are included in the scope of the invention.

The entire disclosure of Japanese Patent Application No. 2014-129437, filed Jun. 24, 2014 is expressly incorporated by reference herein.

What is claimed is:

1. An ink jet recording apparatus, comprising:

a housing that forms an upper housing and a lower housing;

a recording head that performs recording by ejecting liquid onto a medium provided in the housing;

a base portion provided in a position that faces the recording head and has a medium supporting portion that supports the medium;

a protruding portion that is provided integrally on one end of the base portion, and extends in a first direction intersecting a transportation direction of the medium and suppresses the deflection of the base portion, the protruding portion extending in a downward direction from the base portion to thereby come into close proximity to a bottom surface of the lower housing; and a storing chamber that stores waste liquid generated from the recording head and is provided on the lower housing, wherein the lower housing includes a front wall and an area that defines the storing chamber, and a receiving portion that is formed between the area and the front wall, wherein the receiving portion receives the protruding portion, wherein the protruding portion defines a space where a portion of the base portion supports a shaft of a discharge roller.

2. The ink jet recording apparatus according to claim 1, wherein the storing chamber includes a first storing chamber and a second storing chamber, the first storing chamber stores a waste liquid absorbing body that absorbs waste liquid led to a lower side of the base portion, the second storing chamber detachably stores a cartridge that maintains the waste liquid delivered by a pump provided in the case, and the first storing chamber and the second storing chamber are arranged in parallel in the transportation direction of the medium on the lower side of the base portion.

3. The ink jet recording apparatus according to claim 2, wherein the receiving portion is formed between a side wall formed on at least one of the first storing chamber and the second storing chamber and a side wall of the case.

4. The ink jet recording apparatus according to claim 2, wherein the protruding portion is positioned between the storing chamber and a side surface of the case positioned on the lower stream side of the storing chamber in the transportation direction of the medium, in the transportation direction of the medium.

5. The ink jet recording apparatus according to claim 2, wherein the protruding portion comes close to the side surface of the case in the case.

6. The ink jet recording apparatus according to claim 1, further comprising:

a transporting roller that transports a medium to the recording head and that is provided on the upper stream side of the recording head in the transportation direction of the medium, and wherein the base portion supports at least one portion of a rotation shaft of the transporting roller in an axial direction of the rotation shaft.

7. The ink jet recording apparatus according to claim 1, further comprising:

a transporting roller that transports a medium to the recording head and that is provided on the upper stream side of the recording head in the transportation direction of the medium, and wherein the base portion supports at least one portion of a rotation shaft of the transporting roller in an axial direction of the rotation shaft.

8. The ink jet recording apparatus according to claim 1, further comprising: a transporting roller that transports a medium to the recording head and that is provided on the upper stream side of the recording head in the transportation direction of the medium; a driving source that is provided on an upper stream side of the base portion in the transportation direction; and a driving force transmitting mechanism that includes plural gear wheels arranged from the upper stream side to the lower stream side in the transportation direction of the medium and transmits a driving force to the transporting roller and the discharge roller from the driving source.

9. The ink jet recording apparatus according to claim 1, further comprising a second protruding portion that is provided in the base portion, and extends in a first direction intersecting a transportation direction of the medium, wherein the storing chamber is formed between the protruding portion and the second protruding portion.

* * * * *